US007959021B2

(12) United States Patent
Liang

(10) Patent No.: US 7,959,021 B2
(45) Date of Patent: Jun. 14, 2011

(54) AIR INLET FOR A BABY BOTTLE

(76) Inventor: Hsiao-Chen Liang, Chang Hua Hsien (TW)

( * ) Notice: Subject to any disclaimer, the term of this patent is extended or adjusted under 35 U.S.C. 154(b) by 355 days.

(21) Appl. No.: 12/191,386

(22) Filed: Aug. 14, 2008

(65) Prior Publication Data

US 2010/0038335 A1 Feb. 18, 2010

(51) Int. Cl.

| | |
|---|---|
| ***A61J 9/00*** | (2006.01) |
| ***A61J 9/04*** | (2006.01) |
| ***A61J 11/00*** | (2006.01) |
| ***A61J 11/02*** | (2006.01) |
| ***B65D 51/16*** | (2006.01) |

(52) U.S. Cl. ..... 215/11.5; 215/11.1; 215/902; 220/202; 220/714

(58) Field of Classification Search ..... 215/11.1, 215/11.4, 11.5, 902

See application file for complete search history.

(56) References Cited

U.S. PATENT DOCUMENTS

| | | | | |
|---|---|---|---|---|
| 7,537,128 | B2 * | 5/2009 | Nachumi | 215/11.5 |
| 2005/0236353 | A1 * | 10/2005 | Hsu | 215/11.5 |
| 2006/0213859 | A1 * | 9/2006 | Sheu | 215/11.5 |
| 2009/0014403 | A1 * | 1/2009 | Lu | 215/11.5 |
| 2009/0071926 | A1 * | 3/2009 | Berkovitch et al. | 215/11.4 |

* cited by examiner

*Primary Examiner* — Anthony Stashick
*Assistant Examiner* — Madison L Wright
(74) *Attorney, Agent, or Firm* — Rabin & Berdo, P.C.

(57) ABSTRACT

An air inlet is mounted in a baby bottle and has a valve and an air-inlet tube. The valve has a body, an outer ring and an inner ring. The body has a chamber, multiple separating blocks and multiple liquid channels. The separating blocks are formed on the body and each has a vent. The liquid channels are formed through the body between the separating blocks and communicate with the chamber. The outer ring is formed around the chamber to separate the chamber and the vents. The inner ring is formed on an inner end of the body around the vents and has multiple air inlets. The air-inlet tube is mounted detachably on the inner ring of the valve. Therefore, liquid flows through the liquid channels and the chamber, but air flows through the air inlets and the vents to the air-inlet tube to ensure smooth operation.

6 Claims, 10 Drawing Sheets

AIR INLET FOR A BABY BOTTLE

BACKGROUND OF THE INVENTION

1. Field of the Invention

The present invention relates to an air inlet, and more particularly to an air inlet for a teat to improve airflow for easier suckling.

2. Description of Related Art

With reference to FIGS. 10 to 12, a conventional air inlet tube (60) for a baby bottle (70) is formed on and protrudes from a teat (71) and has an outer end, an inner end, an inlet hole (61) and an air slot (62). The outer end of the air inlet tube (60) is formed on a bottom of the teat (71). The inlet hole (61) is formed through the outer end of the air inlet tube (60). The air slot (62) is formed on the inner end of the air inlet tube (60) and communicates with the inlet hole (61).

The teat (71) with the conventional air inlet tube (60) is mounted on an open end of the baby bottle (70) by a collar (72) engaging the baby bottle (70). Generally, the baby bottle (70) contains a liquid (80) to feed a baby, and is inverted before being sucked. Air (90) is sucked into the baby bottle (70) via the air slot (62) and the inlet hole (61) of the air inlet tube (60) to displace the liquid (80) flowing out of the teat (71). However, when the air inlet tube (60) is deep below a surface of the liquid, a high hydraulic pressure prevents easy inflow of air thereby, preventing the liquid (80) flowing out of the baby bottle (70) smoothly. To allow efficient airflow, the air inlet tube (60) should be close to the surface of the liquid (80), either by rotating, tilting or temporarily inverting to allow pressure equalization. However, a baby is incapable of performing these logical operations, so an adult supervisor must perform these tasks to allow easier suckling.

To overcome the shortcomings, the present invention provides an air inlet for a baby bottle to mitigate or obviate the aforementioned problems.

SUMMARY OF THE INVENTION

The main objective of the present invention is to provide an air inlet for a baby bottle to improve airflow for easier suckling.

The air inlet in accordance with the present invention is mounted in a baby bottle and has a valve and an air-inlet tube. The valve has a body, an outer ring and an inner ring. The body has a chamber, multiple separating blocks and multiple liquid channels. The separating blocks are formed on the body and each has a vent. The liquid channels are formed through the body between the separating blocks and communicate with the chamber. The outer ring is formed around the chamber to separate the chamber and the vents. The inner ring is formed on an inner end of the body around the vents and has multiple air inlets. The air-inlet tube is mounted detachably on the inner ring of the valve. Therefore, liquid flows through the liquid channels and the chamber, but air flows through the air inlets and the vents to the air-inlet tube to ensure smooth operation.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
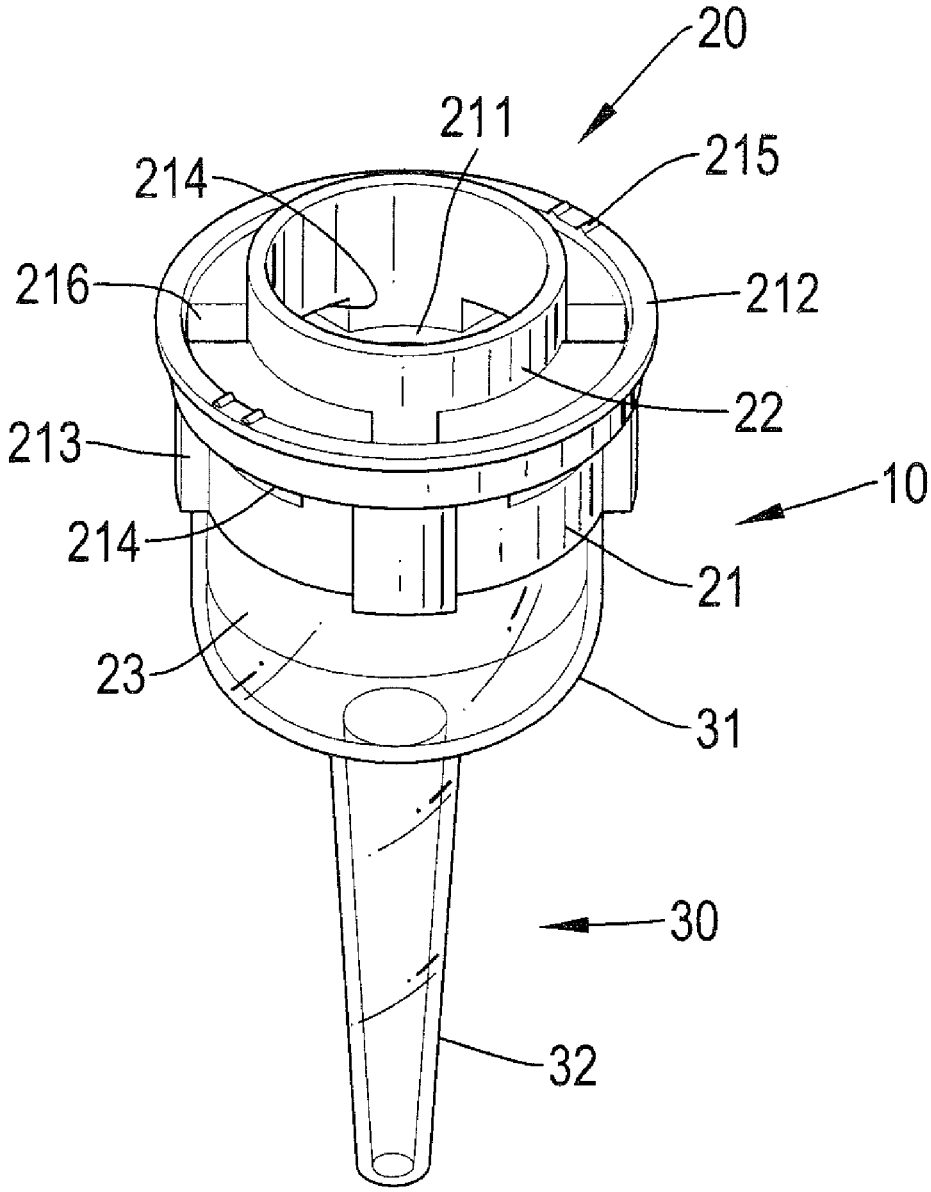
FIG. 1 is a perspective view of an air inlet in accordance with the present invention.
Figure 2:
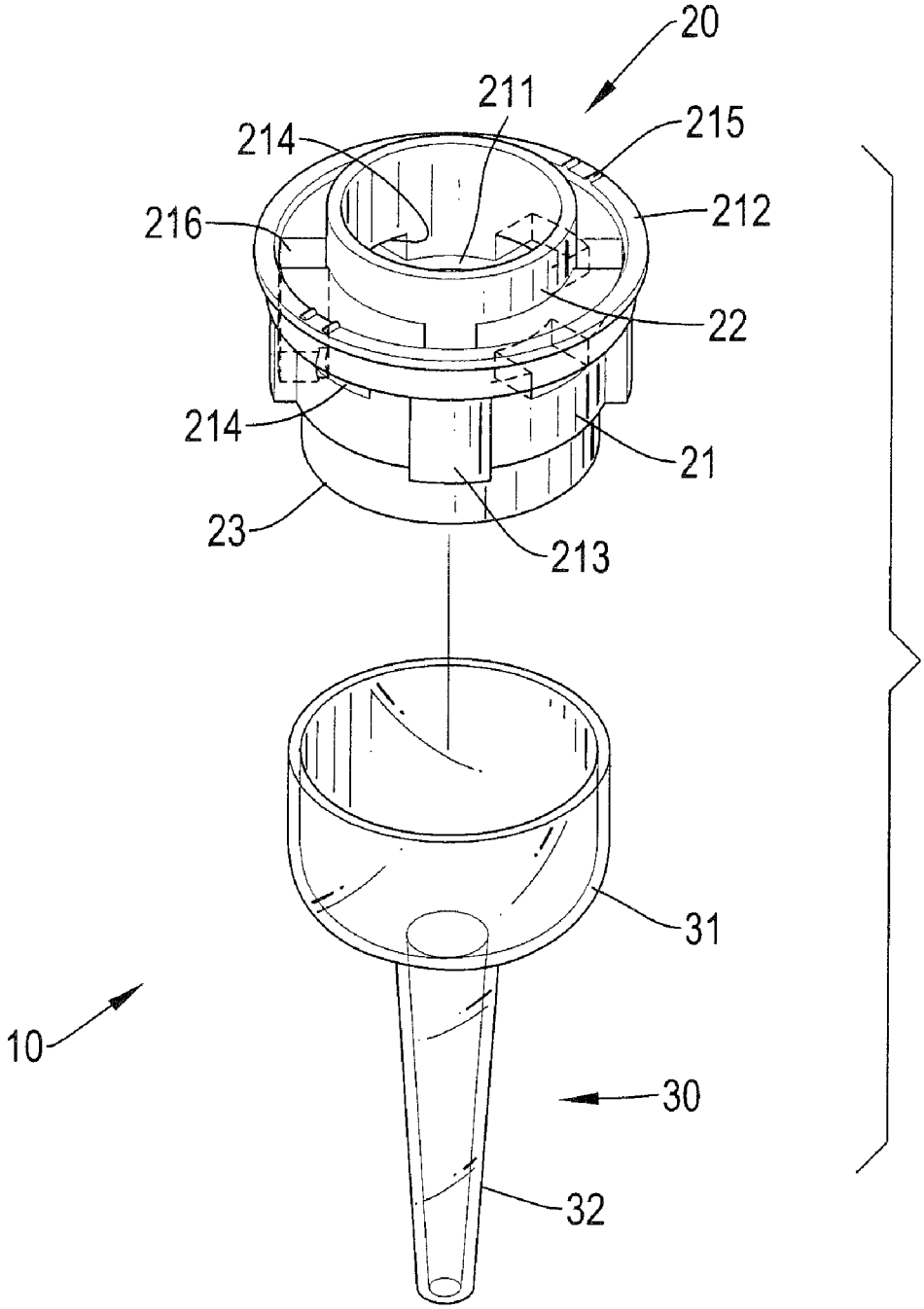
FIG. 2 is an exploded perspective view of the air inlet in FIG. 1.
Figure 3:
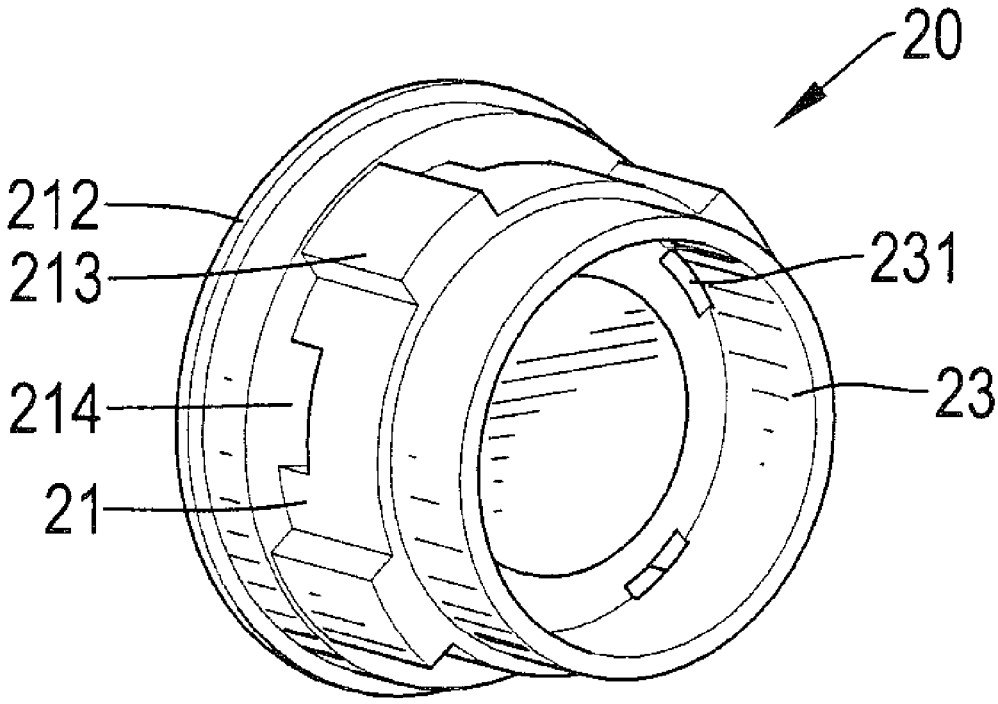
FIG. 3 is a bottom perspective view of a valve of the air inlet in FIG. 1.
Figure 6:
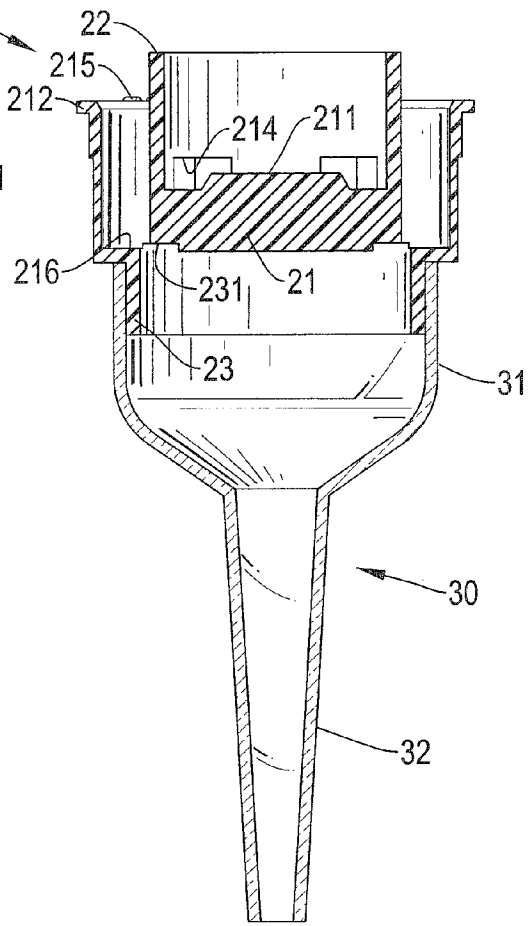
FIG. 6 is a cross sectional side view of the air inlet along line 6-6 in FIG. 4.
Figure 5:
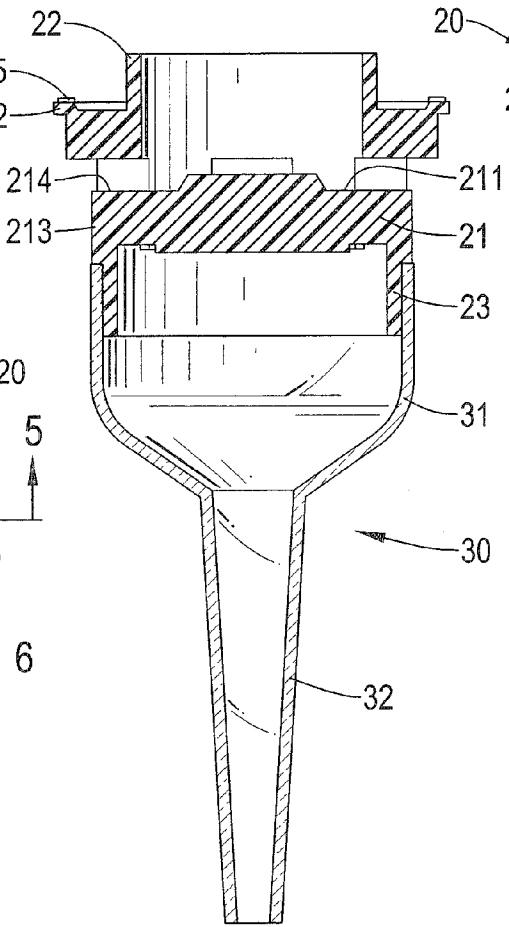
FIG. 5 is a cross sectional side view of the air inlet along line 5-5 in FIG. 4.
Figure 4:
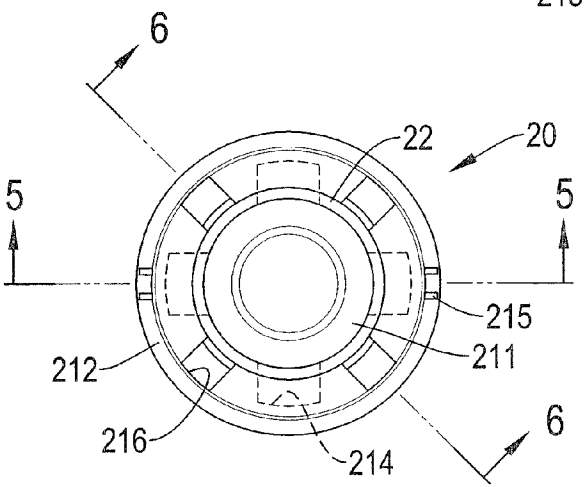
FIG. 4 is a top view of the air inlet in FIG. 1.
Figure 7:
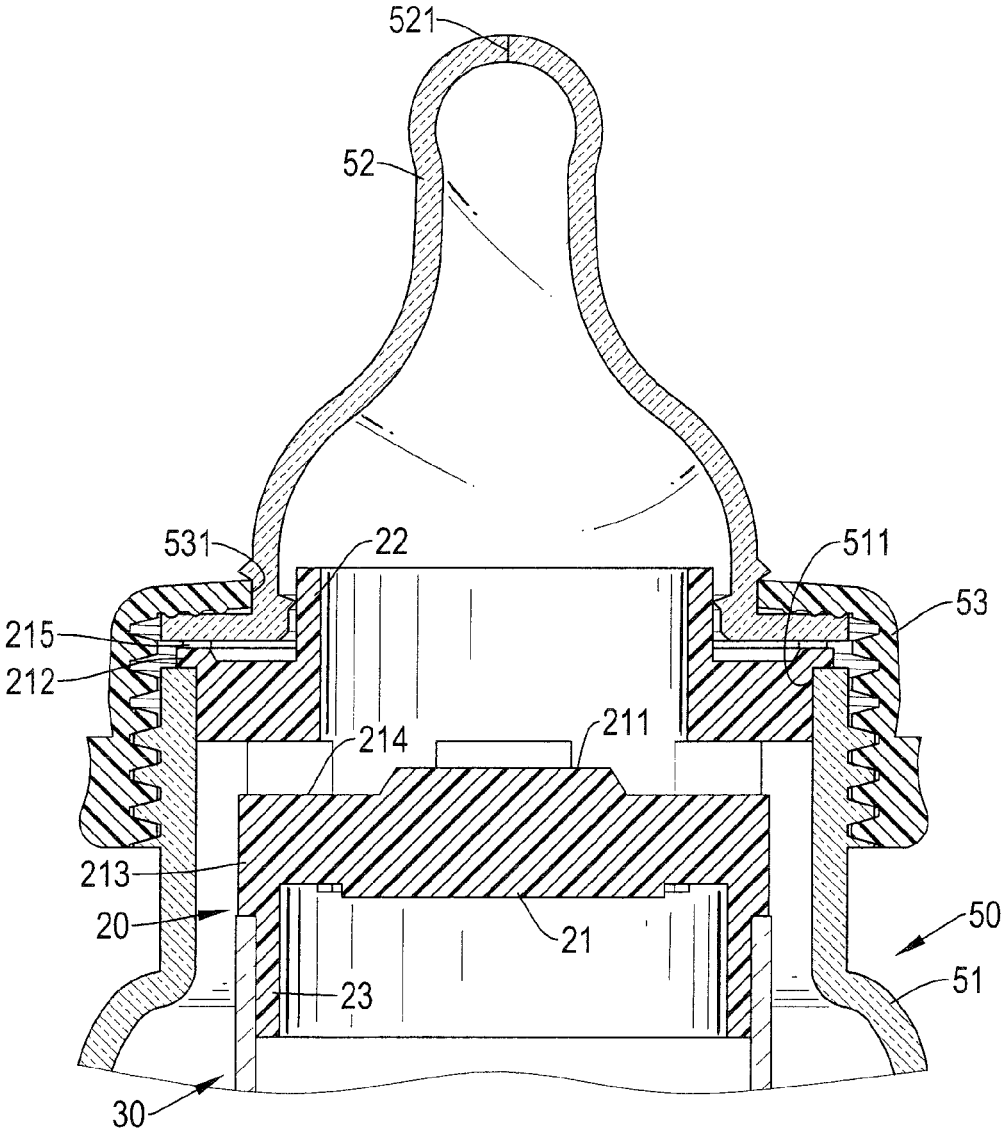
FIG. 7 is an enlarged cross section side view of the air inlet in FIG. 1, shown mounted on a baby bottle with a teat and a collar.

With reference to FIGS. 1 and 7, an air inlet (10) in accordance with the present invention is mounted on a baby bottle (50) having a container (51), a teat (52) and a collar (53) and the air inlet (10) comprises a valve (20) and an air-inlet tube (30).

The container (51) is hollow, holds liquid and has a neck and an opening (511) formed in the neck.

The teat (52) is mounted adjacent to and covers the opening (511) and has a rim, a nipple and a teat slot (521). The rim of the teat (52) is mounted on and seals the opening (511) of the container (51). The nipple is formed on and protrudes from the rim of the teat. The teat slot (521) is formed though an end of the teat (52) and communicates with the opening (511) of the container (51).

The collar (53) is mounted over teat (52) and engages the neck of the container (51) to hold the teat (52) in place and has a through hole (531). The through hole (531) is formed centrally through the collar (53) and is mounted around the nipple of the teat (52).

With further reference to FIGS. 2 to 6, the valve (20) is mounted in the opening (511) of the container (51), abuts the bottom of the teat (52) and has a body (21), am outer ring (22) and an inner ring (23).

The body (21) is mounted in the opening (511) of the container (51) and has an annular surface, an outer end, an inner end, a chamber (211), a holding flange (212), multiple separating blocks (213), multiple liquid channels (214) and multiple ribs (215).

The chamber (211) is centrally formed in the outer end of the body (21).

The holding flange (212) is formed on and protrudes circumferentially from the outer end of the body (21), abuts the container (51) to seal the opening (511) of the container (51) and has an outer surface.

The separating blocks (213) are formed on and protrude from the annular surface of the body (21) at intervals to allow liquid to pass therebetween and each separating block (213) has a vent (216). The vents (216) are respectively formed in the separating blocks (213) and through the outer end of the body (21) and separated from the chamber (211) by the annular surface of the body (21).

The liquid channels (214) are formed radially through the annular surface of the body (21) between the separating blocks (213) and communicate with the chamber (211).

The ribs (215) are formed on and protrude from the outer surface of the holding flange (212) in pairs to form a gap between the body (21) and the teat (52).

The outer ring (22) is formed on and protrudes from the outer end of the body (21), around the chamber (211) and separating the chamber (211) and the vents (216) and the outer ring (22) prevents the teat (52) from being diametrically compressed and removed while in use.

The inner ring (23) is formed on and protrudes from the inner end of the body (21) below the separating blocks (213), is formed with the outer ring (22) and has an internal surface and multiple air inlets (231). The air inlets (231) are formed through the internal surface of the inner ring (23) near the inner end of the body (21) and communicate with the vents (216) of the separating blocks (213).

The air-inlet tube (30) may be funnel shaped, is hollow and is mounted detachably on the inner end of the body (21) and in the container (51) of the baby bottle (50) and has a mounting end (31) and a nozzle end (32).

The mounting end (31) corresponds to and is mounted around the inner ring (23) of the valve (20), abuts the separating blocks (213) and communicates with the air inlets (231) and the vents (216).

The nozzle end (32) is formed on and protrudes from the mounting end (31), is tapered and communicates with the container (51) of the baby bottle (50).

Figure 8:
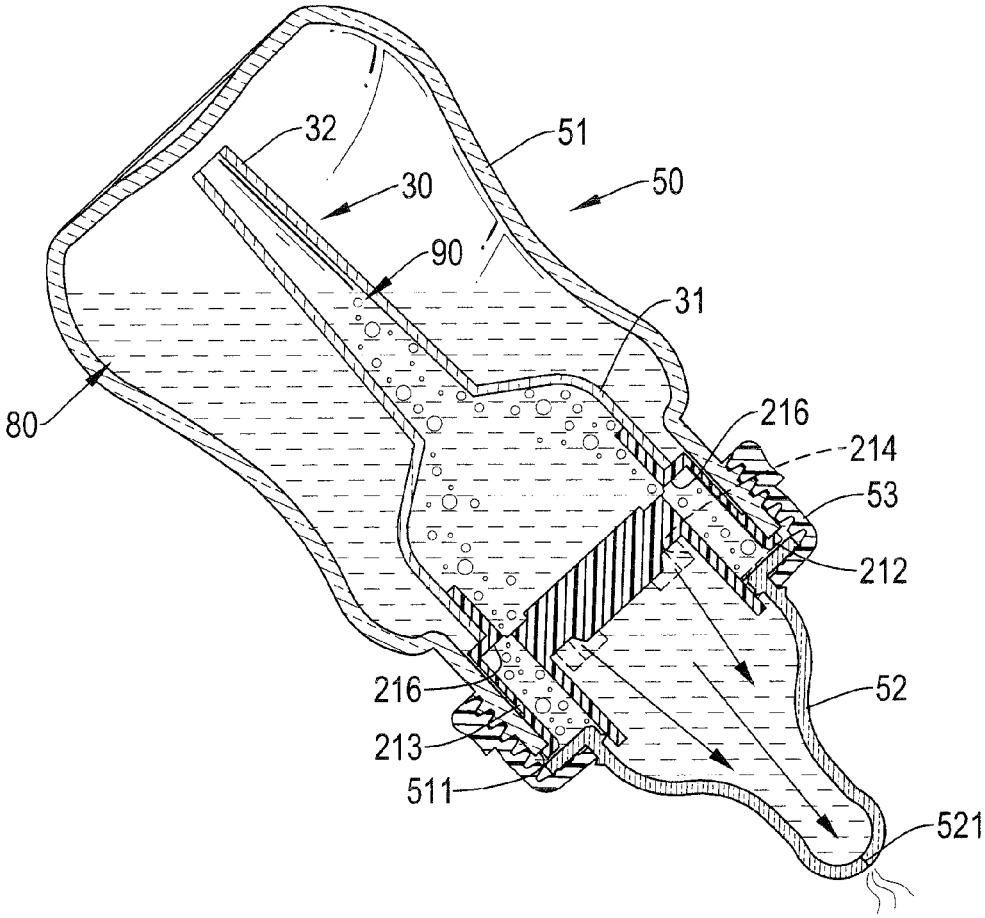
FIG. 8 is an operational side view of the air inlet in FIG. 7 with liquid being contained in the baby bottle.

With further reference to FIG. 8, as the baby bottle (50) contains a liquid (80) and is inverted, when the teat (52) is sucked, the liquid (80) will flow out of the teat (52) via the liquid channels (214) and the teat slot (521). At the same time, the air (90) will flow into the container (51) via the gap between the ribs (215), through the vents (216) of the separating blocks (213), the air inlets (231) of the inner ring (23) and the mounting end (3 1) and the nozzle end (32) of the air-inlet tube (30) without being impeded by hydraulic pressure. Therefore, the liquid (80) that flows out of the teat (52) is isolated from the air (90) that flows into the chamber (512) of the container (51) by the valve (20) and the air-inlet tube (30).

Figure 9:
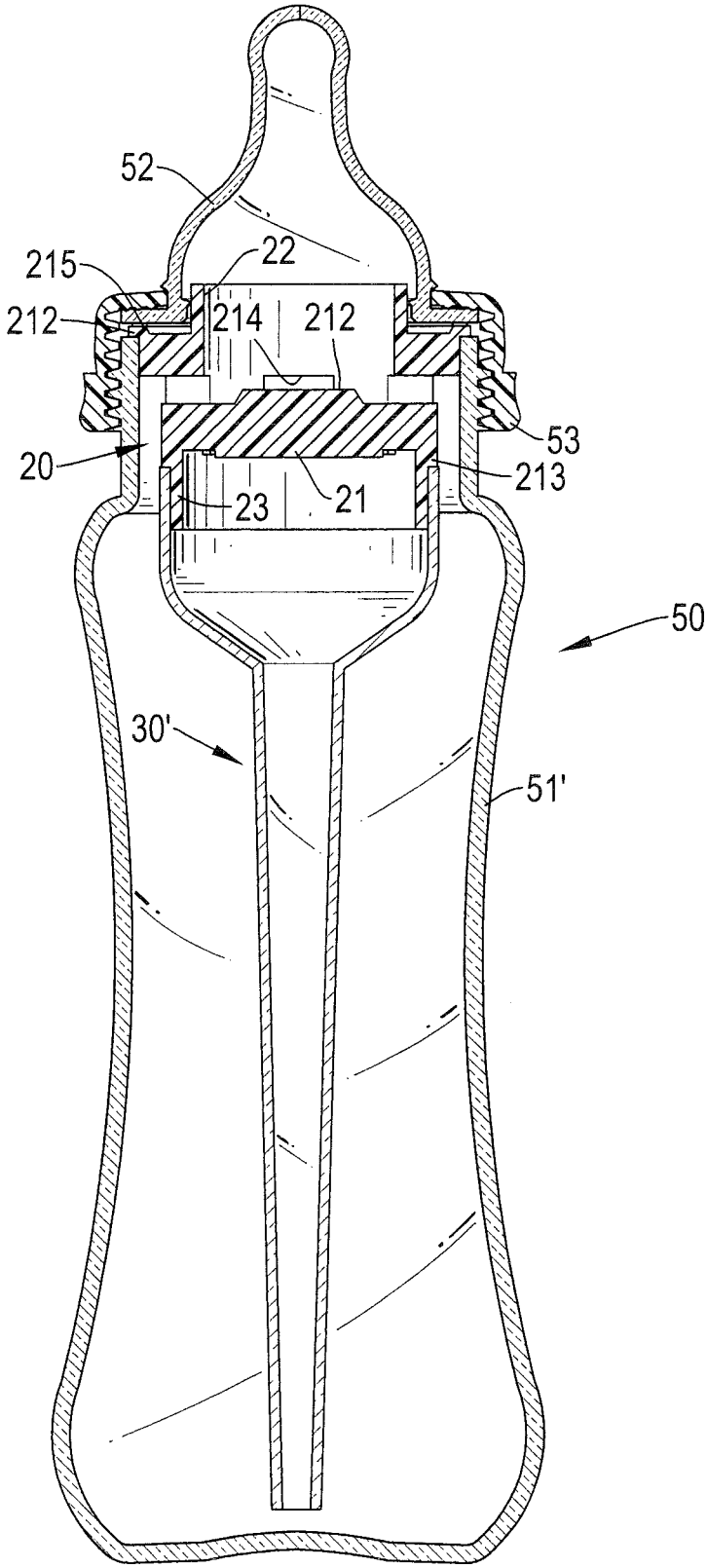
FIG. 9 is a cross section side view of the air inlet in FIG. 1, shown mounted on another baby bottle.
Figure 10:
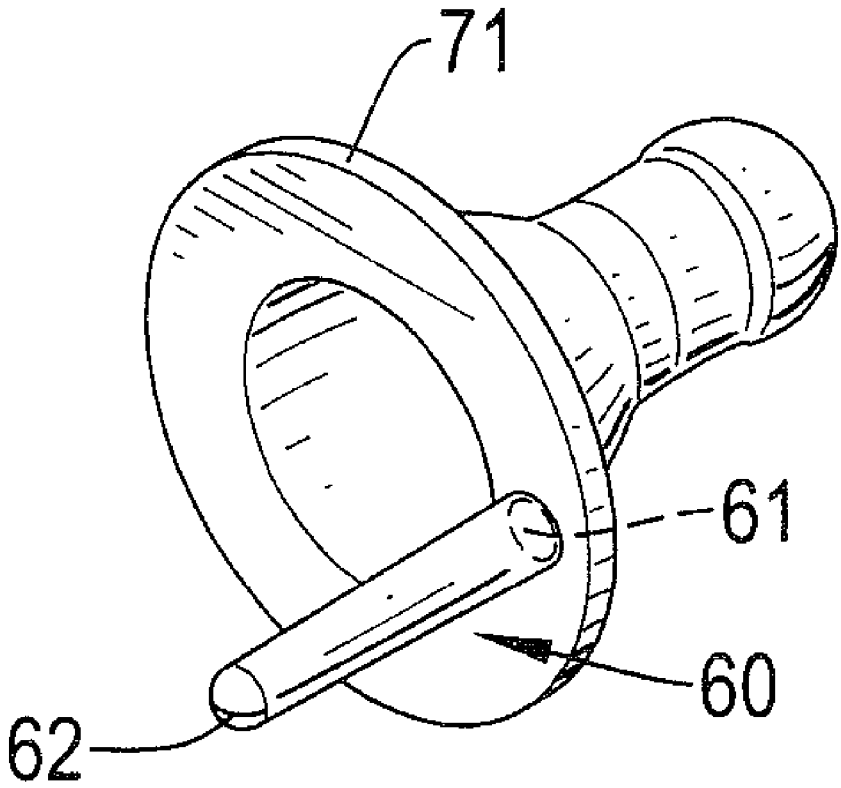
FIG.10 PRIOR ART
FIG. 10 is a perspective view of an air inlet tube in accordance with the prior art formed on a teat.
Figure 11:
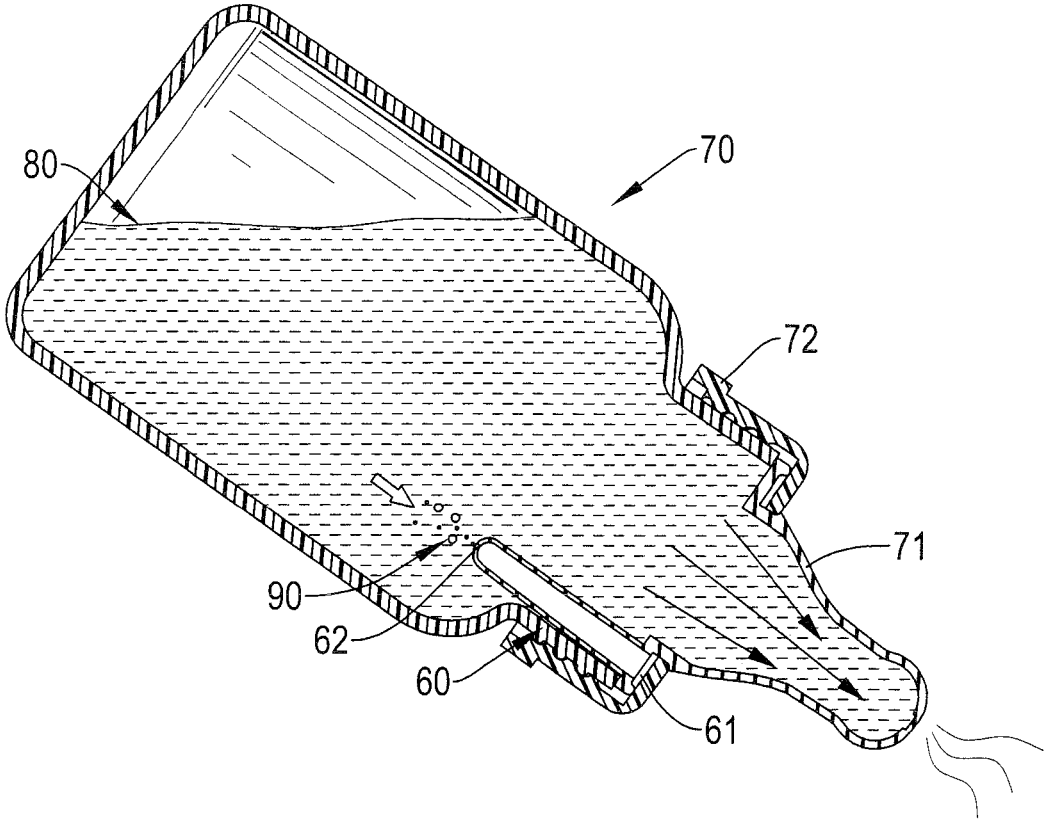
FIG.11 PRIOR ART
FIG. 11 is an operational side view of the air inlet tube on the teat in FIG. 10 mounted on a baby bottle with liquid.
Figure 12:
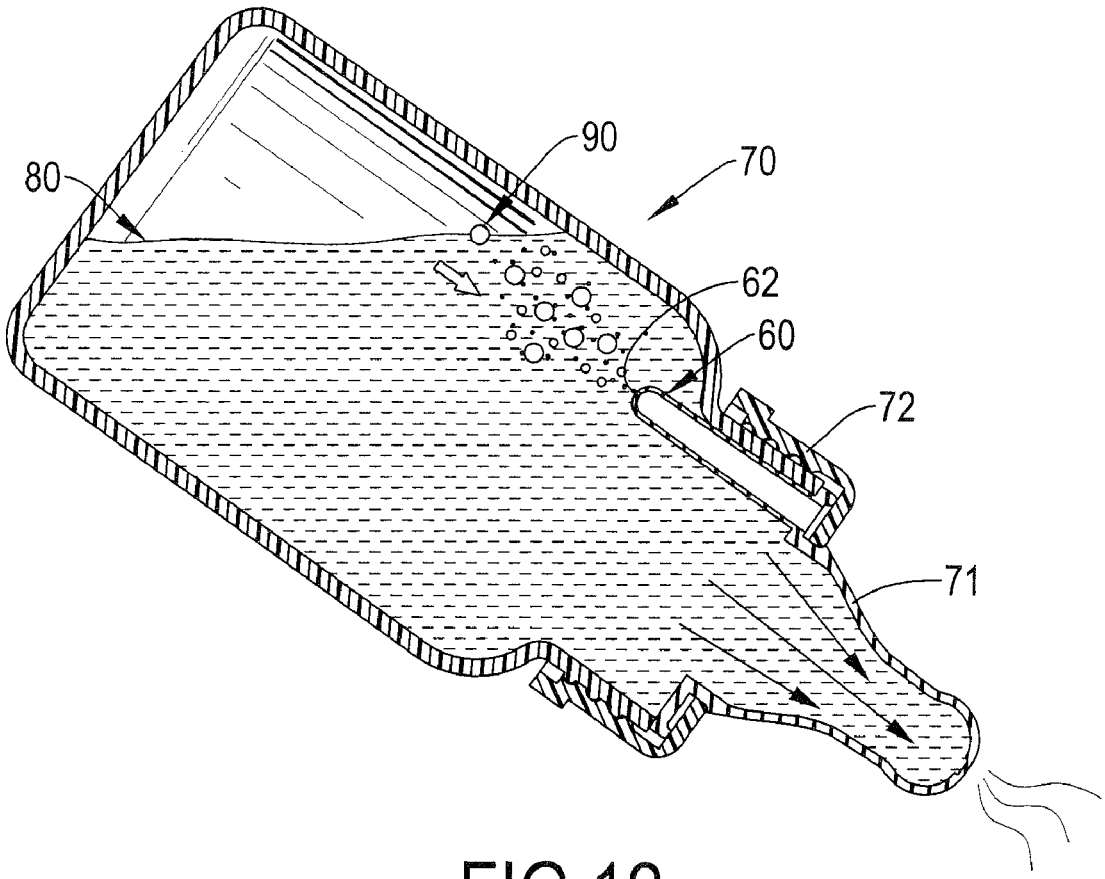
FIG.12 PRIOR ART
FIG. 12 is another operational side view of the air inlet tube with the teat in FIG. 11, the baby bottle having been rotated.

With further reference to FIG. 9, the air inlet (10) can be used in a variety of baby bottles (50) by replacing the air-inlet tube (30') to correspond with the container (51').

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air inlet for a baby bottle comprising a container, a teat and a collar, and the air inlet having a valve adapted to mount in the baby bottle between the container and the teat and having a body adapted to mount in an opening formed in a neck of the container so as to abut a bottom of the teat, the body having an annular surface;

an outer end;

an inner end;

a single chamber formed in the outer end of the body;

multiple separating blocks formed on and protruding from the annular surface of the body at spaced-apart intervals, and each separating block having a vent formed through the separating block, through the outer end of the body and separated from the chamber by the annular surface of the body; and multiple liquid channels formed radially through the annular surface of the body between the separating blocks and communicating with the chamber;

an outer ring formed on and protruding from the outer end of the valve, around the chamber and separating the chamber and the vents; and an inner ring formed on and protruding from the inner end of the body below the separating blocks, and being formed with the outer ring as a single piece and having an internal surface; and multiple air inlets formed through the internal surface of the lower ring near the inner end of the body and communicating with the vents of the separating blocks; and a hollow air-inlet tube mounted detachably on the inner end of the body and having a mounting end corresponding to and being mounted around the inner ring of the valve, abutting the separating blocks and communicating with the air inlets and the vents; and a nozzle end formed on and protruding from the mounting end, and being tapered and adapted for communicating with the container of the baby bottle.

2. The air inlet as claimed in claim 1, wherein the valve further has a holding flange being formed on and protruding circumferentially from the outer end of the body to abut the container and having an outer surface.

3. The air inlet as claimed in claim 2, wherein the valve further has multiple ribs being formed on and protruding from the outer surface of the holding flange in pairs to form a gap between the body and the teat.

4. The air inlet as claimed in claim 3, wherein the body of the air-inlet tube is funnel shaped.

5. The air inlet as claimed in claim 1, wherein the body further has a holding flange being formed on and protruding circumferentially from the outer end of the body to abut the container and having an outer surface; and multiple ribs being formed on and protruding from the outer surface of the holding flange in pairs to form a gap between the body and the teat.

6. The air inlet as claimed in claim 1, wherein the air-inlet tube is funnel shaped.

* * * * *